US009155445B2

(12) United States Patent
Hörsch et al.

(10) Patent No.: US 9,155,445 B2
(45) Date of Patent: Oct. 13, 2015

(54) INTEGRATEABLE DOMESTIC APPLIANCE

(75) Inventors: Julia Hörsch, Heidenheim (DE); Cengiz Kücük, Syrgenstein (DE); Wilhelm Thibaut, Sontheim (DE)

(73) Assignee: BSH Hausgeraete GmbH, Munich (DE)

( * ) Notice: Subject to any disclaimer, the term of this patent is extended or adjusted under 35 U.S.C. 154(b) by 239 days.

(21) Appl. No.: 13/396,762

(22) Filed: Feb. 15, 2012

(65) Prior Publication Data

US 2012/0206027 A1 Aug. 16, 2012

(30) Foreign Application Priority Data

Feb. 16, 2011 (DE) ..... 10 2011 004 217

(51) Int. Cl.

| | |
|---|---|
| ***A47B 77/06*** | (2006.01) |
| ***A47L 19/02*** | (2006.01) |
| ***A47L 15/42*** | (2006.01) |
| ***D06F 39/12*** | (2006.01) |
| ***F24C 15/08*** | (2006.01) |

(52) U.S. Cl.

CPC ..... *A47L 15/4272* (2013.01); *D06F 39/12* (2013.01); *F24C 15/08* (2013.01); *A47L 15/4246* (2013.01); *A47L 15/4268* (2013.01)

(58) Field of Classification Search

USPC ..... 312/228, 328, 351.1–352; 134/56 D, 134/25.2

See application file for complete search history.

(56) References Cited

U.S. PATENT DOCUMENTS

| | | | | | |
|---|---|---|---|---|---|
| RE20,925 | E | * | 11/1938 | Rees | 248/188.2 |
| 6,045,203 | A | * | 4/2000 | Marks et al. | 312/228 |
| 7,586,069 | B2 | * | 9/2009 | Inoue et al. | 219/756 |
| 2008/0127456 | A1 | * | 6/2008 | Maunsell et al. | 16/400 |
| 2009/0126765 | A1 | * | 5/2009 | Buehlmeyer et al. | 134/115 R |

FOREIGN PATENT DOCUMENTS

| | | | | |
|---|---|---|---|---|
| DE | 4443919 | A1 | | 6/1996 |
| DE | 10 2007 052 072 | | * | 5/2009 |
| DE | 102007052072 | A1 | | 5/2009 |
| DE | 10 2008 032 266 | | * | 1/2010 |
| DE | 10 2010 038 483 | | * | 2/2012 |
| WO | 2009068395 | A1 | | 6/2009 |

OTHER PUBLICATIONS

National Search Report EP 12 15 3089.

* cited by examiner

*Primary Examiner* — Matthew Ing
*Assistant Examiner* — Timothy M Ayres
(74) *Attorney, Agent, or Firm* — James E. Howard; Andre Pallapies

(57) ABSTRACT

A domestic appliance, in particular a dishwasher, includes a container for receiving items to be processed, and at least one load limiter which is held directly or indirectly on the container and constructed to absorb a load. The load limiter is provided with at least one open or enclosed recess for engagement of at least one tab assigned to an outer region of the container in a mounted position of the at least one load limiter.

22 Claims, 6 Drawing Sheets

INTEGRATEABLE DOMESTIC APPLIANCE

BACKGROUND OF THE INVENTION

The invention relates to a domestic appliance, in particular a dishwasher, whereby the domestic appliance has a container for receiving items to be processed, to which, in the integrated position, at least one load limiter is assigned, in particular to support it against a surrounding kitchen furniture unit or a wall in an integrated state and/or to support against external forces in a stacked or lifted state during transportation or temporary storage, in accordance with the preamble of claim 1.

Numerous domestic appliances are known, which have a container for processing introduced items. In the case of a dishwasher, such a container may be perhaps a wash tub provided with spray arm(s) and/or spray nozzles and one or more racks. Such a container is usually held in an essentially square housing which surrounds the latter at a distance. It is known here to arrange holders on upper housing edges, by way of which the housing can be fixed to a kitchen furniture unit, for instance by way of screws. This nevertheless presupposes the presence of such an external housing, furthermore, additional components or additional components to be installed on site are needed with the said holders.

In recent years such domestic appliances are frequently being used for integration into kitchen furniture, said domestic appliances no longer comprising a complete external housing, for the purpose of saving on material and weight, so that the outer wall of the said container essentially also simultaneously forms the outer contour of the domestic appliance at least in the upper region. Consequently, maintaining distance and supporting the domestic appliance on the surrounding kitchen furniture unit and/or a wall of the room is also needed here in order to ensure a play-free fit. Resistance against a deformation caused by external force effects during transportation or temporary storage, by means of forklift trucks for instance, is likewise to be ensured here. This also applies to such domestic appliances, which comprise an external housing, which is itself however not embodied sufficiently stable such that it could counteract the said external forces. Load limiters are then also to be provided here between the housing and the container, said load limiters preventing an excessive loading of the housing and/or container.

So-called load limiters made of plastic for instance are therefore frequently mounted on the outside, in particular on upper corner regions of the container, said load limiters being used in particular to support against a surrounding kitchen furniture unit or a wall in an integrated state and/or to support against external forces in a stacked or lifted state during transportation or temporary storage.

The load limiter is currently installed by screwing it to the container. It is necessary here for the screws to be manually fixed to the container through holes drilled in the load limiter, so that the effort involved in installation is relatively high and with one screw being used per load limiter, meaning that the prospect of the respective load limiter twisting with respect to its desired position is also not ruled out at least over the long term.

BRIEF SUMMARY OF THE INVENTION

The problem underlying the invention is to create a fixing possibility for load limiters assigned externally to the container which can be easily installed for a household appliance.

The invention solves this problem by means of a domestic appliance, in particular a dishwasher, having the features of claim 1. Further advantages and features as well as developments of the invention are specified in claims 2 to 16.

A domestic appliance is created by means of the invention which, apart from a container for receiving items to be processed, does not require a housing or only requires a housing which is embodied to be mechanically light and thin. Consequently, for instance in an integrated state, it can be supported against a surrounding kitchen furniture unit, like for instance adjacent cupboards or a work surface, and/or held at a distance and supported against a wall, by way of its one or more inventively embodied load limiters. It is also protected against a deforming effect of external forces in a stacked or lifted state during transportation or temporary storage. In this case the fact that the load limiter or each load limiter is provided with at least one open, in particular open-edged or enclosed recess, into which, in the installed position of the respective load limiter, at least one tab assigned to the outer edge of the container or similar hook-type holder engages, means that the respective load limiter is secured to the container, without a screw connection or similar time-consuming installation having to take place herefor. This speeds up and simplifies installation. Separate fastening means, like for instance screws, are no longer needed so that material is also saved.

Particularly favorably for an upward support (stackability) and lateral support (gripping by means of clamps) the load limiter or limiters are held on the upper corner regions of the container.

In particular, the tab or a similar hook-type holder can be formed by a folded edge during installation of the respective load limiter, so that a one-off application of force in only one direction may be sufficient herefor. If necessary, the respective tab can be formed by a number of folded edges. In particular, the respective folded edge can also be embodied in a number of directions.

Expediently the edge folding of the tab or other holder can be performed automatically operated by a punch moving into the recess, for instance a hydraulically actuated punch, so that no manual intervention is needed.

If the punch has a horizontal feed direction in parallel with an outer surface of the container, the alignment of the container and punch relative to one another is simplified. Relatively large tolerances may occur without this jeopardizing the result. In particular, a number of punches for folding over the corresponding holders for a number of load limiters can also deploy at the same time in order to accelerate installation.

From a manufacturing point of view, it is in particular favorable for the use of the said punching method to punch the tab or other hook-type holder from a container rear wall or an essentially upright flange. A sub region can be bent forwards from the rear wall or the flange, in particular by approximately 70° to 90°, and here engage in a positionally-secure fashion into the recess of the load limiter, in particular can press this then firmly against the container.

Provided the recess opens into a channel extended in the depth direction of the domestic appliance and the tab(s) or other hook-type holder(s) is/are connected to at least one wall of the respective channel, the force effect securing the container can be distributed onto a long extended region of the load limiter.

The edge folding can take place if necessary about a number of bending lines, so that a number of tabs or suchlike can only be formed with just one punch and these fix the respective load limiter particularly advantageously both vertically downwards and also horizontally relative to the transverse center and secure the same in a play-free fashion.

The pressable sub region of the container rear wall or a flange can be expediently defined by boundary limits of the recesses on the load limiters. The edge folding then takes place precisely where it is optimally positioned in proportion to the respective load limiter. The load limiter and the container can be aligned during installation with generous tolerances.

A simpler extrusion of the sub region is enabled if one or more notches or relief cuts introduced into the container rear wall or the upright flange exist prior to installation, in particular punched-out sections, which can be easily introduced into the comparatively thin sheet metal. These punched-out sections do not have to not directly indicate the folded edge lines, but instead only enable the folding back.

The load limiters can be embodied as light injection molded parts which are cost-effective in terms of series manufacturing.

In particular, the said load limiters can be provided on two opposing upper corner regions, whereby, for the stability of the domestic appliance, both a stiffening of the container and also a distance bridge relative to the receiving kitchen furniture unit can be favorably affected by the load limiters.

Load limiters of the said type can be assigned both to the left and right upper corner region of a rear wall and also to the front corner regions on a reinforcing frame surrounding the opening region of the container at least area by area.

Such a reinforcing frame, made of metal for instance, is frequently used in such a container, which is essentially square, open on one side and faces a door opening. The reinforcing frame is then optimally arranged on the outside above this side facing the door opening like a portal in the shape of a letter U, open at the bottom on the top and at least in the upper lateral regions. Such a domestic appliance may then exhibit high stability even without a completely circumferential housing, and up to six of these devices can be stacked one on top of the other for instance. Also during transportation, two domestic appliances can simultaneously be gripped next to one another by clamps, e.g. of a forklift truck.

Provided the reinforcing frame has a U or L-shaped cross-section and comprises at least one web region protruding upwards from the outer wall of the container, it is expedient to secure, in particular to fix and/or fasten, the front load limiter/s to this at least one web region.

The afore-mentioned and/or advantageous embodiments and developments of the invention reproduced in the subclaims can be used here individually or however also in any combination with one another, except for instance in cases of clear dependencies or inconsistent alternatives.

BRIEF DESCRIPTION OF THE DRAWINGS

The invention and its advantageous embodiments and developments are described below on the basis of drawings, in which, in a schematic basic diagram.

DETAILED DESCRIPTION OF EXEMPLARY EMBODIMENTS OF THE PRESENT INVENTION

Figure 2:
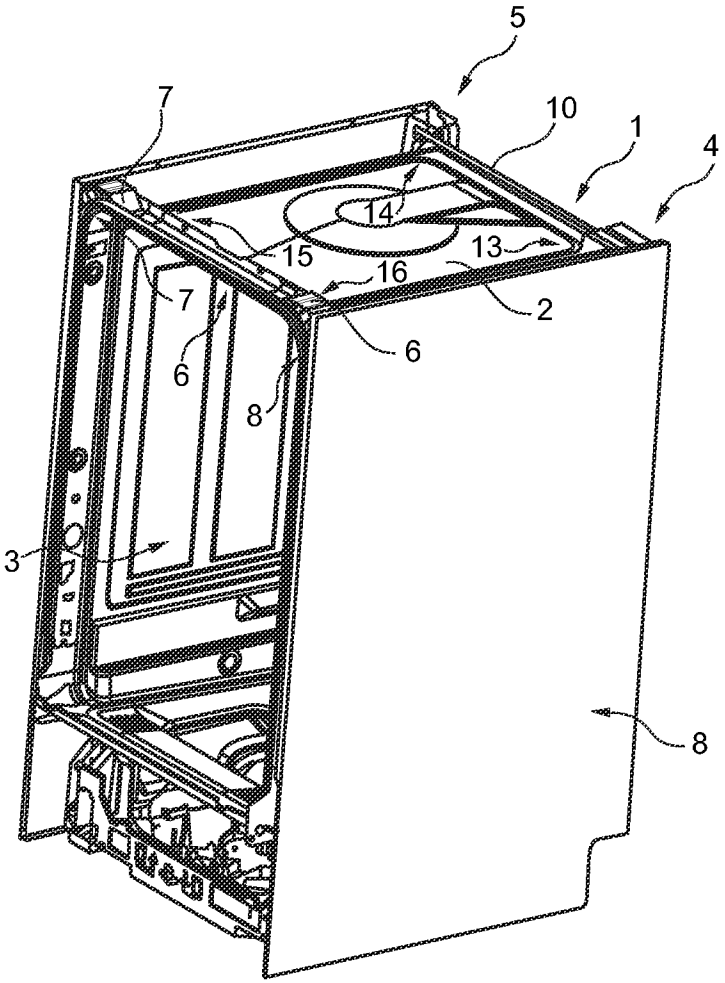
FIG. 2 shows a similar view to FIG. 1, but shows a dishwasher comprising high side walls which protrude upwards beyond the container.

Elements with the same function and mode of operation are provided with the same reference characters in the figures in each instance.

Figure 1:
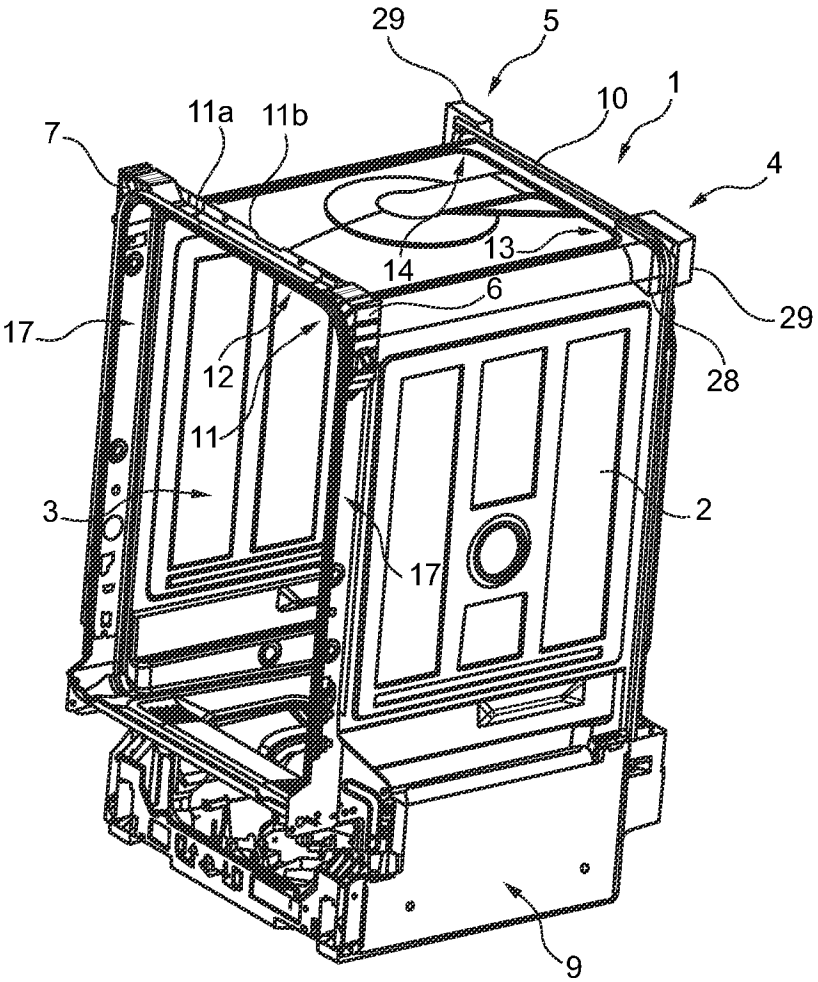
FIG. 1 shows an integrateable domestic appliance, which is formed here as a dishwasher, in an embodiment with so-called shortened side walls so that in the upper region outside of the container for processing items to be introduced, no external housing is provided and in a schematic perspective view oblique from above, for improved clarity, is shown without a door and some further elements, whereby load limiters are assigned to the upper front and rear corners of the container, of which, here in the left rear corner, only a part of the load limiter engaging behind the rear wall of the container is shown.
Figure 3:
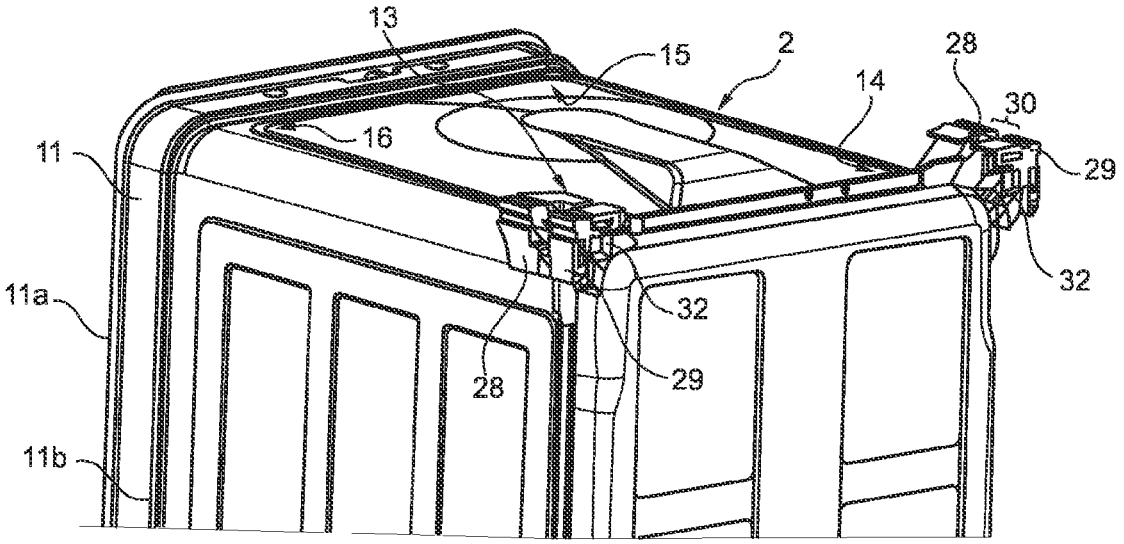
FIG. 3 shows a detailed view of the upper region of the dishwasher from FIG. 1, but without the load limiter assigned to the front side, in a perspective view oblique from the rear.

The electrically-operable domestic appliance 1 shown by way of example in FIG. 1 is embodied here as a dishwasher. Other domestic appliances can also be inventively embodied, for instance washing machines, tumble dryers, steamers, microwave devices, integrated ovens or suchlike.

The dishwasher 1 shown includes a container 2 for receiving items to be processed, here a wash tub for receiving items to be cleaned, like for instance dishes, glasses, cutlery, cooking utensils or suchlike, whereby according to the drawing, the container 2 comprises a loading and unloading opening on its front side 3 facing a user, which can be closed by means of a door (not shown). This can swing open downwards for instance. In this open position, the domestic appliance 1 can therefore be located in a front-loaded position, which, particularly with a crockery basket pulled out (not shown here) can be even more marked. Provision is made for a number of load limiters 4, 5, 6, 7 assigned to the upper region of the device 1 in order inter alia to stop the domestic appliance 1 from tilting forwards (and also for stacking of a number of devices or for transportation, in particular using clamps, e.g. of a forklift truck), by way of which load limiters a deforming external force during transportation and stacking is counteracted and/or by way of which it is secured in its integrated position with respect to a receiving kitchen furniture unit. In the integrated position, these load limiters 4, 5, 6, 7 maintain a constant distance with respect to the surrounding kitchen furniture unit or a lateral wall and/or during transportation with respect to further devices or jaws of a clamp. This also applies to the distance relative to a lateral wall 8, which can also be provided along with the domestic appliance 1. An upper cover plate of the device 1 can likewise also be held by way of the load limiters 4, 5, 6, 7 (not shown here), provided the device is to be used on its own.

Another type of door opening is also possible. Alternatively, a door could also be arranged on the top side of the container 2.

Since the domestic appliance 1 shown in the exemplary embodiment can be integrated in the kitchen furniture unit, it does not necessarily need to comprise such side walls 8, which, standing adjacent to the container 2 on the outside and connecting thereto, protrude upwards beyond the container 2, as shown in FIG. 2. Instead, as shown in FIG. 1, only one low side wall 9 can be provided in the lower region of the domestic appliance 1, so that, aside from the upper corners 13, 14, 15, 16, no side wall parts or other parts of an external housing exist.

The load limiters 4, 5, 6, 7 are therefore arranged irrespective of the presence and embodiment of an external housing on the container 2 which surrounds said container 2.

According to the drawing, both front, in other words upper corner regions 15, 16 facing the front opening 3 and also rear corner regions 13, 14 closing a rear wall 10 on the top side are provided with load limiters 4, 5, 6, 7 in each instance, which can provide both a stiffening of the container 2 and also a distance bridge and can prevent the container 2 being deformed. Load limiters of this type are therefore basically standard in integrated appliances. Their numbers may vary.

Unlike known load limiters which are embodied for example from Styrofoam and hold against the corner regions such that a high side wall 8 clamps the load limiter between itself and the container 2, the at least one load limiter 4, 5, 6, 7 is embodied here as a plastic injection molded part and held independently against the container 2.

Figure 7:
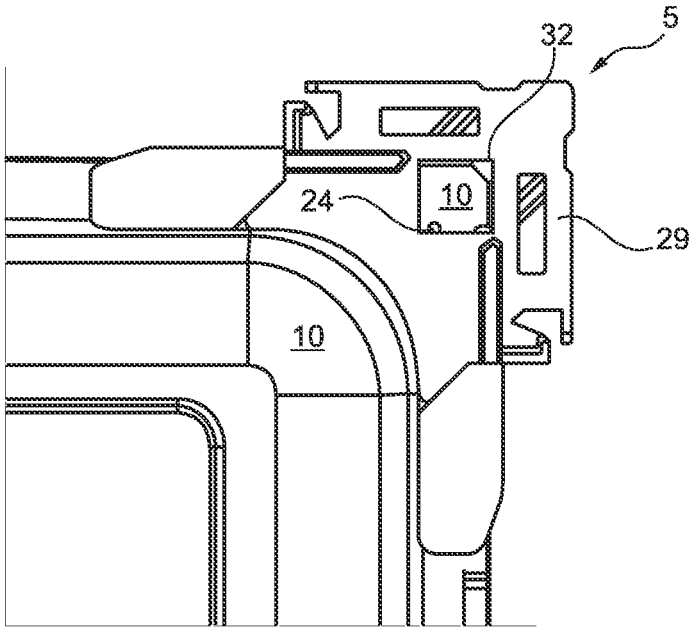
FIG. 7 shows the rear wall according to FIGS. 5 and 6 with the load limiter positioned thereupon but not yet fixed thereto.
Figure 8:
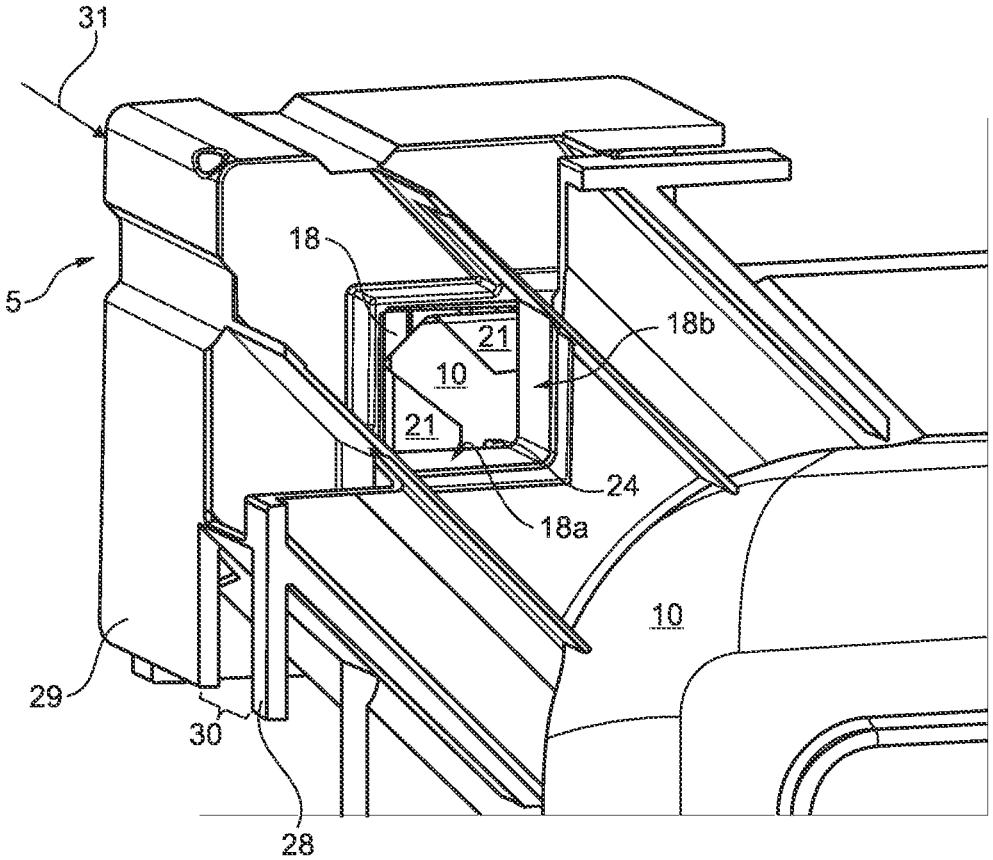
FIG. 8 shows the installed state according to FIG. 7 obliquely from the front, whereby the load limiter is shown in section for better clarity.
Figure 9:
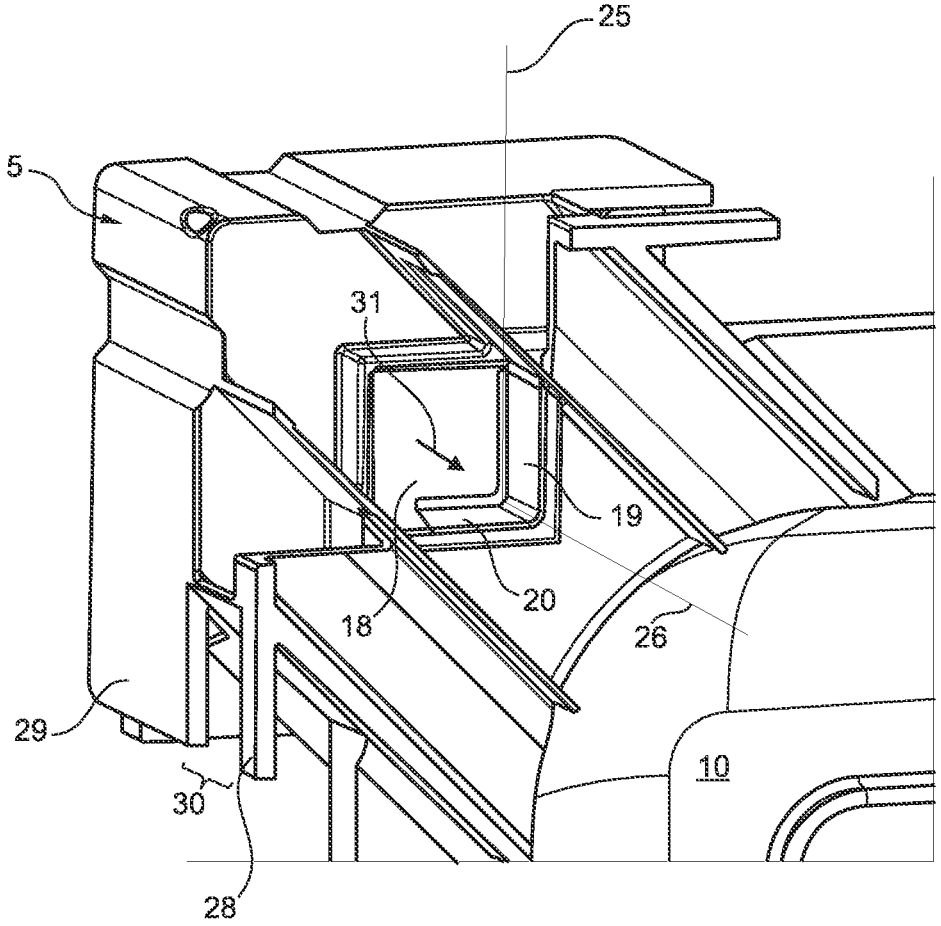
FIG. 9 shows a similar view to FIG. 8, but after insertion of a punch from the rear in order to bend two tabs of the rear wall so as to hold the load limiter.

The container 2 may consist for instance entirely of stainless steel or also of a number of components, for instance also of a base unit made of plastic and a hood unit made of stainless steel. According to the drawing, the container 2 is essentially square here and in an area close to its open front side 3 comprises a reinforcing frame 11 which surrounds the same at least in some areas. This is provided with a transverse part 1 on the outside on the container 2 and above the front door opening. Side limbs 17 of the reinforcing frame 11 which point downwards extend from there vertically downwards along the at least upper regions of the sides of the container 2. The reinforcing frame according to FIG. 7 approximately is shaped, when viewed from the front, like a letter U open at the bottom.

The reinforcing frame 11 shown here is needed in any event or at least advantageous in order to embody a stackability of such domestic appliances 1 so that it does not form an additional component. The frame part 11 is metallic, possibly made of steel, and is welded to the container 2 in lines or at a number of points. In dishwashers, up to six domestic appliances 1 which are reinforced with such a frame part 11 can be stacked one above the other. Domestic appliances 1 reinforced with such a frame part 11 can also be gripped individually or several at a time by the sides within clamping jaws e.g. of a forklift truck and transported.

The reinforcing frame 11 here also has a U or L-shaped cross-section and comprises two parallel web or flange regions 11*a* and 11*b* which are at a distance from one another, on which one or a number of front load limiter/s 6, 7 can be fastened. Here the respective load limiter preferably lies in a plane spanned by the height direction and width direction of the wash tub.

An exemplary embodiment for the fastening of the rear load limiter 4, 5 is described below. It goes without saying however that such a type of fastening can also be provided for front load limiters 6, 7 and in each instance for at least one of the load limiters 4, 5, 6, 7 up to all load limiters.

Figure 10:
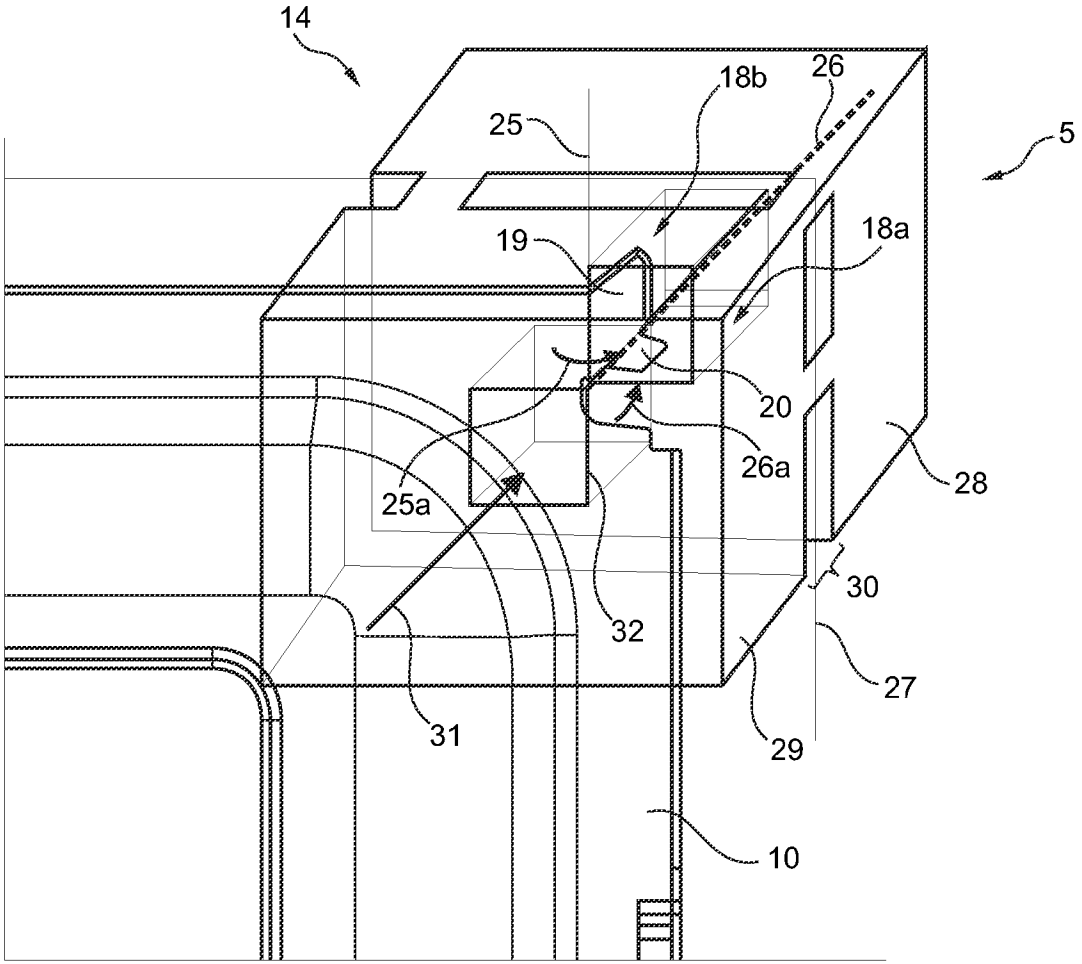
FIG. 10 shows the installation state according to FIG. 9 in a schematic view obliquely from the rear.

According to the drawing up to FIG. 10, the load limiters 4, 5, which are fastened to the upper corner 13, 14 of the rear wall 10, are provided with at least one open or enclosed channel-type recess 18, into which, in an installed state of the respective load limiter 5, 6, at least one tab 19, 20 assigned to the outer edge of the container 2, here two tabs assigned to the upper edge of the rear wall 10, or similar hook-type holder(s) engage/s. The channel-type recess 19 extends here preferably in the depth direction of the wash tub.

Figure 11:
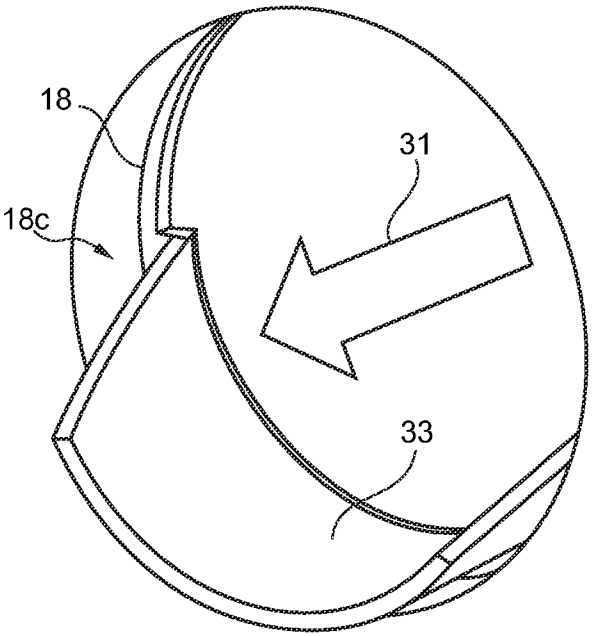
FIG. 11 shows a detailed view of an alternative round insertion opening for a punch into the load limiter to fasten the same by means of a rounded tab.

Alternatively, a round recess 18 is indicated in FIG. 11, on the edge region of which a continuous, likewise rounded tab 33 is formed according to the punch method (crimping process) described below, which connects to the inner wall 18*c* of the round recess 18. A cup-type embossing thus results. A secure connection of the load limiter 4, 5 and the container 2 is also ensured here.

Other forms are also possible. The recess 18 can be open at the edge or arranged as a channel in the load limiter 4, 5, 6, 7 which encloses all sides.

In the first exemplary embodiment, the rear wall 10, which is formed for instance from stainless steel and may be provided with folds 21 on its lateral and upper edge regions for improved stability, can be provided with an approximately L-shaped notch or a relief cut 22, which can be formed for instance by means of punching out and includes a first limb 23 which proceeds transversely inwards from the vertical edge region and a second limb 24 which proceeds upwards from there. Such a punching out may retain its sharp edges in order to be able to cut into the plastic of the load limiter 4, 5, during the bending process described in more detail below. This embodiment is only exemplary and is adjusted in each instance to the, here rectangular, edge contour of the channel-type recess 18 in the load limiter 3 or 4, on the outer edges of which the tabs 19, 20 are produced by folding around the bending edges 25, 26 (a curved bending edge is produced in the second exemplary embodiment according to FIG. 11). The bending edge 26 rests here in the continuation of the protruding limb 24 of the punching out 22, which therewith specifies a target bending line. A material thinning or suchlike does not have to be provided here for the bending edges 25, 26 however.

To enable the bending, the load limiters 3, 4 each include a front and a rear body 28, 29, which are connected to one another, but nevertheless leave a vertical gap 30 between them (FIG. 10), in which the rear wall 10 with its edge regions protruding upwards and to the side of the container 1 can rest. For illustration purposes, the virtual plane 27 which continues upwards and laterally beyond the rear wall 10 is shown in FIG. 10.

During installation, a punch is pressed in direction 31 into a rear passage channel 32 of the rear body 29 for instance, said punch striking the rear wall 10 after passing through the body 29 and pressing against the edge and into the recess 19 of the front body 28 which lies flush with the passage channel 32, so that the tab 19 is formed on the edges of this recess about the vertical bending line 25 in the direction of arrow 25*a* and simultaneously the tab 20 is formed by bending in the direction of arrow 26*a* about the bending line 26. Here at least the lower tab 20 also cuts into the edge of the channel 18, so that a crimping results. The tabs 20, 19 formed by folded edges during installation of the respective load limiter 4, 5, or similar hook-type holders therewith rests against a lower surface

18*a* and against a side surface 18*b* of the load limiter 3 shown here and therewith secure the load limiter 5 both transversely inwards and also downwards so that it is fixedly pressed against the container 2 in two directions.

Figure 4:
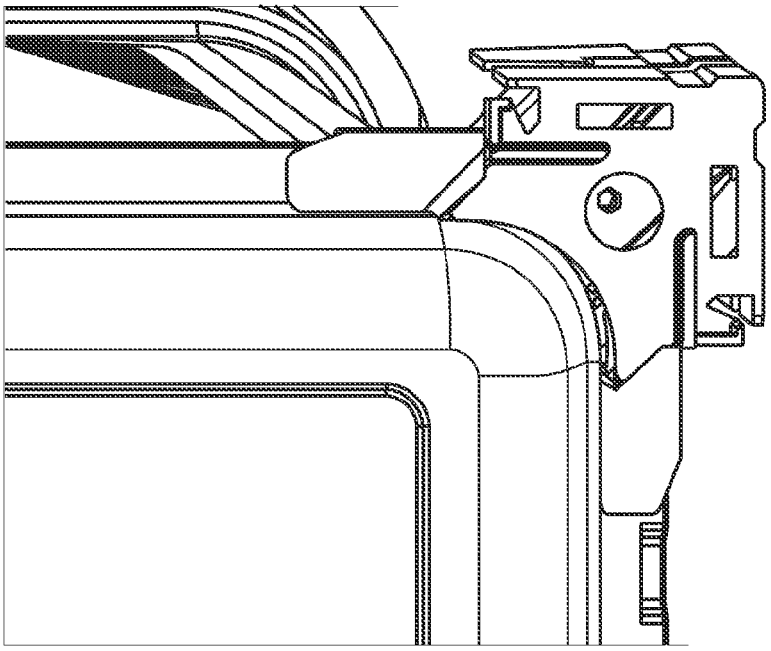
FIG. 4 shows a detailed view of an upper rear corner region of a conventional dishwasher, into the load limiter of which a screwdriver must be engaged so as to be fasten it to the container.
Figure 5:
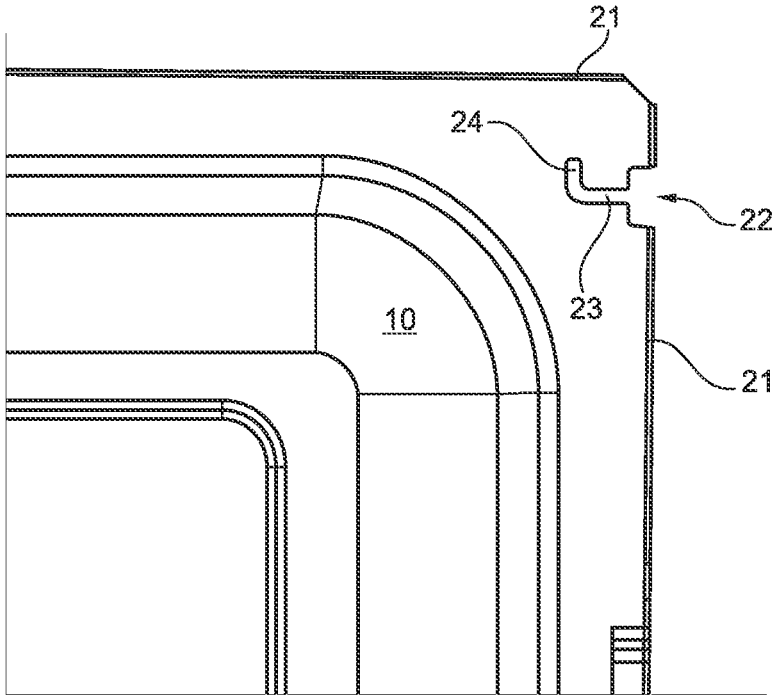
FIG. 5 shows a top view onto an upper corner region of a rear wall of a container having a notch or relief cut so as to enable the folding of one or more tabs which are to bend outwards from the rear wall in order to hold a load limiter not yet installed here.
Figure 6:
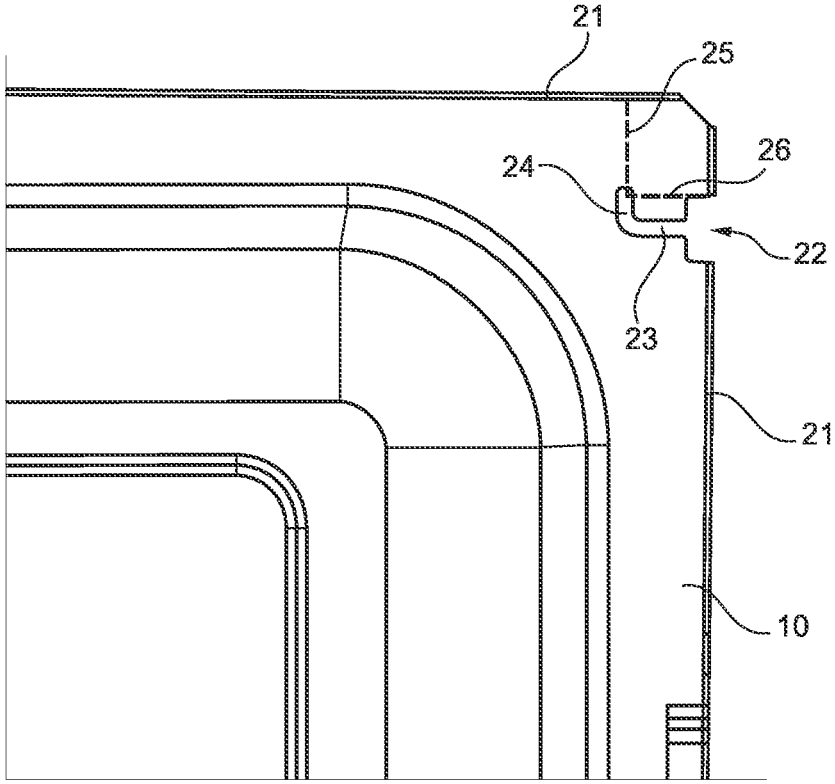
FIG. 6 shows a similar view to FIG. 5, nevertheless shown with additionally marked bending edges.

The folded edge of the holder is able to be produced automatically by means of a punch which runs into the recess 18 in a horizontal feed direction 31 parallel to side walls of the container 2 so that no rotation of a screwdriver or other manual work process is needed, as necessary in the prior art and indicated in FIG. 4 with the hole and screw to be driven into it. Depending on space available, the punch can enter from the front or from the rear. Entry from the rear is frequently more favorable for the region of the rear wall 10.

By means of the punch engagement 31, the tabs 19, 20 or other hook-type holder formed here are extruded out of the container rear wall 10 (and/or forwards out of an upright web-type flange 11*a*, 11*b* and bent in particular here by approximately 70° to 90° about the axes 25, 26.

Here the recess 18 forms a channel extended in the depth direction of the domestic appliance, so that the tab (s) 19, 20 or other hook-type holder(s) can be attached in a planar fashion to its inner walls 18*a*, 18*b* and can also be cut into the plastic in a crimping fashion. In particular, a form-fit attachment of the tabs 19, 20, 33 results, to which the thus embodied load limiters 4, 5, 6, 7 can be fixed. The load limiter 4, 5, 6, 7 is automatically used on the container 2 on account of the geometry of the tab 19, 20, 33. This prevents the load limiter 4, 5, 6, 7 from resting obliquely or incorrectly on the container 2.

In particular, a number of load limiters (for instance 4, 5) can also be embodied as identical parts and optionally attached to the right or left.

The shape of the tabs 19, 20 is determined here by the boundary limits of the recesses 18 on the load limiters 4, 5, which define the bending lines 25. 26. More than one such recess 18 can also be provided per load limiter 4, 5, similarly more than one notch 22.

With the invention it is possible to dispense with several or all screws of the load limiter on the container 2. This simplifies installation. The described crimping process does not generate any labor costs on account of its automatic process, so that this, and also material for additional fastening means which are no longer needed, can be saved. A notch 22 can be introduced automatically and without labor costs.

A circumferential housing, to the upper edge of which holders can be easily screwed, is unnecessary on the inventive domestic appliance, but can nevertheless still be provided. The inventive embodiment can then also provide advantages, additional strips, hooks, external tabs or similar additional components are not needed. The same load limiter 4, 5, 6, 7 can be used with each external embodiment.

What is claimed is:

1. A domestic appliance, comprising:

a container for receiving items to be processed, the container including at least three walls delimiting an interior space, the container having a cut formed in the container on an exterior portion thereof thereby forming at least one tab on the container; and at least one load limiter configured to be positioned directly on the exterior portion of the container and subsequently securely held on the container, the load limiter being constructed to absorb a load, said load limiter provided with at least one open or enclosed recess for engagement of the at least one tab assigned to an outer region of the container in a mounting position of the at least one load limiter, wherein an edge of the container including the at least one tab is configured to be movable from a first position to a second position and into engagement with the load limiter in the at least one open or enclosed recess while the load limiter is positioned directly on the exterior portion of the container, the second position being angled with respect to the first position, the edge of the container including the at least one tab is arranged in the first position when the load limiter is positioned on the container and is arranged in the second position to secure the load limiter on the container, the recess is embodied as a channel in a depth direction of the domestic appliance, said tab being attached to at least one wall of the channel, and the cut includes a first potion and a second portion, the second portion being disposed at an angle with the first portion.

2. The domestic appliance of claim 1, constructed in the form of a dishwasher.

3. The domestic appliance of claim 1 wherein the load limited is attached to support against a surrounding kitchen furniture unit or a wall in an integrated state and/or to support against external forces in a stacked or raised state during transportation or temporary storage.

4. The domestic appliance of claim 3, wherein the load limiter is held on a rear wall of the container.

5. The domestic appliance of claim 4, wherein the open or enclosed recess is configured as a channel in a depth direction of the appliance.

6. The domestic appliance of claim 5, wherein the tab is assigned to an outer edge of the rear wall of the container.

7. The domestic appliance of claim 6, wherein the tab is associated with the outer edge of the rear wall of the container in the form of an essentially vertically standing flange and is configured to be pushed out of the flange in such a way that a sub region of the tab is bent and thereby folded over by approximately 70 to 90°.

8. The domestic appliance of claim 1, wherein the tab has a hook-shaped configuration.

9. The domestic appliance of claim 1, wherein the load limiter is held on at least an upper corner region of the container.

10. The domestic appliance of claim 1, wherein the tab is pushed out of a container rear wall or an essentially vertically standing flange, from which a sub region is bent.

11. The domestic appliance of claim 10, wherein the sub region is bent by approximately 70° to 90°.

12. The domestic appliance of claim 10, wherein the tab is pushed out by one or more notches introduced into the container rear wall or the essentially vertically standing flange prior to installation.

13. The domestic appliance of claim 12, wherein the notches are configured as relief cuts and/or punched out areas.

14. The domestic appliance of claim 1, wherein the recess is embodied as a channel in a depth direction of the domestic appliance, said tab being attached to at least one wall of the channel.

15. The domestic appliance of claim 1, wherein the tab fixes the load limiter both vertically downwards and also horizontally with respect to a transverse center.

16. The domestic appliance of claim 15, wherein the tab is defined by boundary limits of the recess on the load limiter.

17. The domestic appliance of claim 1, wherein the load limiter is arranged on the container irrespective of the presence and configuration of an external housing surrounding the container.

18. The domestic appliance of claim 1, wherein the container has an upper corner region for attachment of the load limiter and thereby effecting a stiffening of the container and/or a distance bridge relative to a receiving kitchen furniture unit or a wall.

19. The domestic appliance of claim 1, wherein the load limiter is embodied as a plastic injection-molded part.

20. The domestic appliance of claim 1,wherein the container further comprises a reinforcing frame surrounding the container in an area close to an open-side edge, said load limiter having at least one area held against the reinforcing frame.

21. The domestic appliance of claim 20, wherein the container has an essentially square configuration and has one side which faces a door opening, said reinforcing frame being provided on the outside above said side and at least in upper lateral regions of the container.

22. The domestic appliance of claim 20, wherein the reinforcing frame has an U or L-shaped cross-section and comprises at least one web region which protrudes upwards from an outer wall of the container, said load limiter being securable to the web region.

* * * * *